US011585030B1

(12) United States Patent
Kelton et al.

(10) Patent No.: US 11,585,030 B1
(45) Date of Patent: Feb. 21, 2023

(54) PORTABLE PLUNGER-WASH BAG APPARATUS AND METHOD OF USE TO CLEAN LAUNDRY

(71) Applicant: Eve Street Designs Pty Ltd., Queensland (AU)

(72) Inventors: Carrie Anne Kelton, Queensland (AU); Kenneth James Bingham, Queensland (AU)

(73) Assignee: Eve Street Designs PTY LTD., Queensland (AU)

( * ) Notice: Subject to any disclaimer, the term of this patent is extended or adjusted under 35 U.S.C. 154(b) by 0 days.

(21) Appl. No.: 17/966,608

(22) Filed: Oct. 14, 2022

Related U.S. Application Data

(60) Provisional application No. 63/288,596, filed on Dec. 11, 2021.

(51) Int. Cl.
*D06F 5/02* (2006.01)
*D06F 5/00* (2006.01)

(52) U.S. Cl.
CPC ..... *D06F 5/02* (2013.01); *D06F 5/005* (2013.01)

(58) Field of Classification Search
CPC ..... D06F 5/02; D06F 5/005
USPC ..... 8/137
See application file for complete search history.

(56) References Cited

U.S. PATENT DOCUMENTS 1,488,414 A 3/1924 Vail et al.
2,596,791 A 5/1952 Rand
2,786,346 A 3/1957 Brandenburg
4,903,718 A 2/1990 Sullivan
5,267,671 A * 12/1993 Baginski ..... D06F 39/024 68/17 R
5,520,028 A * 5/1996 Kim ..... D06F 43/085 210/411
5,548,859 A 8/1996 Oberg et al.
5,598,641 A * 2/1997 Kishi ..... E03D 11/11 110/238
5,907,908 A * 6/1999 Cunanan ..... B01D 53/263 34/80
6,243,969 B1 * 6/2001 Yeazell ..... D06F 43/00 34/340

(Continued)

FOREIGN PATENT DOCUMENTS

CN 207186195 U 4/2018
DE 847742 8/1952

(Continued)

*Primary Examiner* — Stephen M Gravini
(74) *Attorney, Agent, or Firm* — Invention To Patent Services; Alex Hobson

(57) ABSTRACT

A plunger-wash bag apparatus that has two components, a wash bag for receiving the dirty laundry, water and detergent and a plunger having a plunger cup configured to move up and down within the wash bag to agitate and wash laundry therein. The high level of agitation of the laundry up and down and along the interior of the wash bag effectively scrubs and cleans the laundry. Dirty laundry may be inserted into the interior of the wash bag along with water and detergent, and the valve cap may be placed over the valve opening to seal the valve. The plunger cup may then be inserted through the upper opening of the wash bag and moved up and down. The plunger may include jet apertures that cause the liquid within the wash bag to rush or jet therethrough and thereby more effectively wash the clothes therein.

26 Claims, 5 Drawing Sheets

(56) References Cited

U.S. PATENT DOCUMENTS

| | | | | |
|---|---|---|---|---|
| 6,327,994 | B1 * | 12/2001 | Labrador | B63B 39/06 114/382 |
| 8,438,750 | B2 * | 5/2013 | Dittmer | D06F 58/22 134/42 |
| 8,726,534 | B2 * | 5/2014 | Chappell | F26B 9/003 34/232 |
| 8,935,858 | B2 * | 1/2015 | Cloutier | D06F 49/00 34/105 |
| 9,341,409 | B1 * | 5/2016 | Akers | F26B 9/003 |
| 9,534,327 | B2 | 1/2017 | Newland et al. | |
| 9,611,576 | B2 | 4/2017 | Newland et al. | |
| 10,501,879 | B2 | 12/2019 | Newland et al. | |
| 10,772,477 | B2 * | 9/2020 | Khazaieli | A47L 5/38 |
| 11,214,913 | B2 * | 1/2022 | Cinello | D06F 23/02 |
| 2017/0356114 | A1 * | 12/2017 | Langsam | D06F 5/005 |
| 2020/0408425 | A1 * | 12/2020 | Zchori | F24F 3/1423 |
| 2021/0156069 | A1 * | 5/2021 | Lv | D06F 39/083 |
| 2021/0156072 | A1 * | 5/2021 | Won | D06F 58/24 |
| 2022/0081821 | A1 * | 3/2022 | Xu | B05B 17/06 |
| 2022/0154384 | A1 * | 5/2022 | Zhao | D06F 25/00 |

FOREIGN PATENT DOCUMENTS

| | | | | |
|---|---|---|---|---|
| DE | 102008007759 | A1 * | 6/2009 | C11D 17/041 |
| DE | 202019100476 | U1 | 4/2019 | |
| GB | 308510 | | 3/1928 | |
| GB | 326086 | | 3/1930 | |
| GB | 460424 | | 7/1936 | |
| GB | 461605 | | 2/1937 | |
| GB | 2369094 | A * | 5/2002 | B65D 77/04 |
| JP | 2013034806 | A * | 2/2013 | |
| WO | 9858113 | A2 | 12/1998 | |

* cited by examiner

PORTABLE PLUNGER-WASH BAG APPARATUS AND METHOD OF USE TO CLEAN LAUNDRY

CROSS REFERENCE TO RELATED APPLICATIONS

This application claims the benefit of priority to U.S. provisional patent application No. 63/288,596, filed on Dec. 11, 2021; the entirety of which is hereby incorporated by reference herein.

BACKGROUND OF THE INVENTION

Field of the Invention

The invention relates to a portable plunger-wash bag apparatus and method of using to wash laundry.

Background

Washing laundry when away from the modern conveniences of a washing machine can be challenging. Backpackers in particular value compressible or collapsible systems that are lightweight for storing and transporting in their backpack. Bag washing apparatus exist but rely on manipulating the bag to agitate the laundry within the bag to scrub it. This has limited effectiveness. Some bags include textured surface on the interior to improve the scrubbing function, however, the clothes often get fixed in a position within these bags and the minimal agitation does not expose all surface to these textured surfaces, resulting in clothes that are not effectively cleaned.

SUMMARY OF THE INVENTION

The invention is directed to a plunger-wash bag apparatus that has two components, a wash bag for receiving the dirty laundry, water and detergent and a plunger having a plunger cup configured to move up and down within the wash bag to agitate and wash laundry therein. The high level of agitation of the laundry up and down and along the interior of the wash bag effectively scrubs and cleans the laundry. Dirty laundry may be inserted into the interior of the wash bag along with water and detergent, and the valve cap may be placed over the valve opening to seal the valve. The plunger cup may then be inserted through the upper opening of the wash bag and moved up and down, and/or twisted. The plunger can then be removed and the liquid can be drained from the wash bag, such as from a valve opening or a drain opening. Draining from the upper opening may be difficult for larger bags and the laundry may slip out if the bag is tilted or inverted. The upper opening may preferably be sealed prior to draining the wash liquid from the wash bag. After draining the wash liquid, rinse liquid may be inserted into the wash bag and again, the plunger may be inserted and plunged up and down and/or twisted to rinse the laundry. This rinse process may be repeated any number of times with fresh rinse water until the laundry is effectively rinsed. The portable plunger-wash bag apparatus is compact, collapsible and enables effective washing of laundry in remote locations.

The plunger may include apertures that cause the liquid within the wash bag to rush or jet therethrough and thereby more effectively wash the clothes therein. These jet apertures may extend through the plunger cup and allow a flow of liquid and/or air therethrough. The jet apertures may prevent the plunger from forming suction as the plunger is withdrawn from down within the wash bag. The jet apertures may also reduce the force required to plunge the plunger cup down into the wash or rinse liquid as the liquid will be forced through the jet apertures. The jet apertures may be located on a receiver portion of the plunger, receiver apertures, and/or on the flared cup portion of the plunger, or cup apertures. The plunger may include one or more plunger jet apertures, such as two, three, four or more, five or more, six or more or any range between and including the number of jet apertures listed. Jet apertures may be configured about every 45 degrees or less around the perimeter of the plunger, about every 60 degrees or less, about every 90 degree or less or about every 180 degrees or less. The plunger jet apertures may be sized to provide effective cleaning and suction reduction, such as about 0.25 $cm^2$ or more, about 0.5 $cm^2$ or more, about 1 $cm^2$ or more, about 2 $cm^2$ or more about 3 $cm^2$ or more about 4 $cm^2$ or more and any range between and including the areas provided.

The wash bag is a flexible receptacle having an upper opening for receiving the laundry and the plunger therein. An exemplary wash bag is an elongated wash bag having a length that is at least twice the width or diameter of the base. An exemplary wash bag is cylindrical in shape from the bottom to the upper opening. The width or the diameter of the wash bag may narrow from the upper opening to the base and may taper gradually toward the base. Therefore, the wash bag may be conical in shape over at least a portion of the length of the flexible receptacle. This tapering in the flexible receptacle diameter may cause the outer perimeter of the plunger cup to create more pressure and higher liquid flows around the perimeter of the plunger to scrub and wash the laundry. The taper of the wash bag may include a bottom that is about 5% smaller in dimension or diameter than the upper opening, or about 10% smaller than the upper opening.

An exemplary flexible receptacle of the wash bag is waterproof and may be made out of a plastic film, a fabric that includes a waterproof coating or film or some other composite material. In an exemplary embodiment, the flexible receptacle of the wash bag is about 0.4 mm thick or more, about 0.5 mm or more, about 1 mm thick or more, about 1.3 mm thick or more, about 2 mm thick or more and any range between and including the thickness values provided. An exemplary flexible receptacle and/or base includes or consists of a polymer film including, but not limited to, a polyethylene, polyurethane, silicone, polyester, polyamide or a composite of polymer materials.

An exemplary wash bag is sized to accommodate at least several pieces of clothing and may have a length of about 30 cm or more about 40 cm or more, about 50 cm or more, about 60 cm or more, about 70 cm or more about 85 cm or more and any range between and including the length values provided. The diameter or width, as used herein, of the bottom or base of the wash bag may be about 15 cm or more, about 20 cm or more, about 25 cm or more, about 30 cm or more, about 35 cm or more, about 40 cm or more and any range between and including the width values provided. The width of the upper opening may be larger than the width of the base by about 5% or more, about 7.5% or more about 10% or more and any range between and including the percentages provided. The wash bag may be sized for a variety of applications. The interior volume of the wash bag may be about 5 liters or more; about 10 liters or more; about 15 liters or about 20 liters or more, about 30 liters or more, about 40 liters or more, about 50 liters or more and any range between and including the volumes provided, such as from about 10 liters to about 50 liters. For backpacking trips, a smaller wash bag may be desired as it will take up less room and will be lighter weight. For car camping adventures, a larger or taller and wider wash bag may be desired to reduce the number of washings required.

An exemplary wash bag has a flexible receptacle, a flat bottom and an upper opening. The flexible receptacle is flexible to enable the wash bag to be compressed or folded or even rolled up for storage and transport. However, the flexible receptacle may be stiff enough to enable the wash bag to be free-standing on the base, wherein the wash bag will stand upright on a flat ground surface without any additional support. The wash bag may have a flat bottom that further enables the wash bag to be free-standing.

The upper opening of the wash bag may be configured with a stiffener that is more rigid than the flexible receptacle material. The stiffener may be a strip of material configured along the upper opening that enables the upper opening of the wash bag to be folded over the stiffener a number of times to effectively seal the upper opening of the wash bag, such as at least one or more folds, two or more folds, three or more folds and even four or more folds. At least two or three folds may be required to effectively seal the liquid in the wash bag. The stiffener may have a width extending down from the upper opening that is about 5 mm or more, about 10 mm or more, about 15 mm or more about 20 mm or more. The stiffener may extend along one side of the upper opening or along about half of the perimeter or may extend all the way along the perimeter. The stiffener may made out of or include materials that are stiffer than flexible receptacle and may include, polyimide, polyester, canvas, wire, fabric composites, such as a polymer coated fabric and the like.

A fastener may be coupled with the upper opening, such as to the stiffener configured along the upper opening to retain the wash bag in a sealed configuration with the upper opening folded down over the stiffener a plurality of times. The fastener may extend from opposing sides of the upper opening or stiffener and can be pulled together and fastened to prevent the folded over upper opening from unfolding. An exemplary fastener is a detachably attachable fastener such as a buckle, snap, button, clip, hook-and-loop fastener and the like. An exemplary fastener is a snap-fit buckle type fastener having an insert portion and a receiver portion. The fasteners may be directly attached to the upper opening or the stiffener or may be coupled with a ring, such as a D-ring or other connector. The insert portion is inserted into the receiver portion and a prong or prongs of the insert portion expand out after being compressed at the insert portion opening to lock the fastener together.

A stabilizing strap may extend from the upper opening of the wash bag, such as from the stiffener and may have a hand loop coupled thereto to allow a person to hold the hand loop and secure the wash bag in position while plunging the plunger up and down with the wash bag. A person may put tension on the stabilizing strap by pulling on the hand loop as they plunge the laundry within the wash bag. The hand loop may also provide a convenient means to carry the wash bag.

A wash bag may have a valve configured to allow liquid to drain from or liquid to be inserted into the interior of the wash bag. A valve may have a detachably attachable valve cap configured to seal the valve opening. The valve opening may be configured more proximal to the upper opening, or top of the wash bag than the bottom of the wash bag. The valve opening may be configured between a centerline of the wash bag length and the top or upper opening of the wash bag. The valve may be opened to allow liquid, such as dirty wash water to drain from the wash bag and clean water may be poured into the wash bag through the valve opening, for example. An exemplary wash bag may have a second valve opening, or a drain opening, configured more proximal to the bottom of the wash bag to allow liquid to be drained from the wash bag without tilting or lifting the wash bag. This secondary drain opening may also have a drain cap configured to seal the drain opening closed to prevent liquid from passing through the drain opening during washing and rinsing. The drain opening may be configured up from the bottom of the wash bag no more than about 10 cm, or no more than about 5 cm, or no more than 3 cm, or no more than about 2 cm and any range between and including the distances provided. The closer the drain opening is to the bottom or base, the more completely liquid can be drained from the wash bag without lifting the wash bag, which may be most useful for larger wash bags. An exemplary wash bag with both a valve opening and a drain opening may enable rinse water to be poured into the upper valve opening and drained from the drain opening, thereby facilitating the rinsing process. The valve opening may enable water and detergent to be drained therefrom as well and may facilitate partial draining of the liquid when washing with less water is desired.

An exemplary plunger has a shaft that extends from a handle, on a handle end, to a plunger cup, on a plunger end. The handle may have a handle opening to provide better manual control and interface with the plunger. The shaft may be collapsible in length to aid in storing and transport. An adjustment feature, such as an adjustment ring, may be used to modify the length of the shaft and may be used to lock a first shaft section in a fixed position with respect to a second shaft section. The second shaft section may be telescoping with the first shaft section, or vice versa. The plunger cup may have an upper receiver configured to receive and retain the plunger shaft, which may be threaded to engage with threads of the plunger end of the shaft. The plunger has a flared portion that flares outward from the upper receiver to the lower flange. A plunger interior is dome shaped to capture water and force water down and then around the plunger flange. One or more plunger jet apertures may be configured in the flared portion to prevent suction during the washing. The plunger jet apertures may allow air and liquid to pass through to prevent the plunger from having too much resistance when moved up and down within the wash bag. These plunger jet apertures may also direct water through the plunger cup to produce jets of water to improve cleaning. The plunger may have strengthening ribs configured along the flared portion of the plunger, such as along the interior of the plunger flared portion, to prevent the plunger from deflecting or deforming during the washing process.

The plunger cup has a width that is less than the width or diameter of the upper opening of the wash bag to enable the plunger cup to extend down into the flexible receptacle to agitate and wash the laundry within the wash bag. The width or diameter of the plunger flange may be some percentage of the diameter or size of the upper opening including, but not limited to, about 20% or more the diameter of the upper opening, about 35% or more, about 50% or more, about 70% or more and any range between and including the percentages of the upper opening provided. The diameter or width, of the lower flange of the plunger cup may be about 5 cm or more, about 7.5 cm or more, about 10 cm or more, about 12.5 cm or more, about 15 cm or more, about 20 cm or more about 30 cm or more and any range between and including the width values provided. The plunger may be an effective amount smaller than the upper opening size or the wash bag size or diameter to prevent sloshing or squirting of liquid out of the upper opening.

The plunger cup may be circular in shape about a perimeter or include one or more perimeter indentations the produces perimeter flow channels between the plunger cup perimeter and the inner surface of the wash bag. These perimeter flow channels may produce a high flow of water therethrough when the plunger is moved up and down within the wash bag to more effectively wash clothes. The perimeter may have two or more indentations, three or more, four or more or five or more. The perimeter may include curved surfaces with perimeter indentations configured at 120 degree intervals about the perimeter with perimeter protrusions between each perimeter indentation. The perimeter of the plunger about the lower flange may be petal shaped, having curved perimeter protrusions alternating with perimeter indentations about the circumference or perimeter of the perimeter cup. An innermost radial extension length of a perimeter indentation, the length from the center of the plunger cup to the most radially inward portion of the perimeter indentation, may be 75% or less or even 50% or less than and outermost radial extension length of a plunger protrusion, the length from the center of the plunger cup to the most radially outward portion of the perimeter protrusion.

A plunger cup may be made out of a resilient material, such as an elastomer including, but not limited to, rubber, silicone, urethane and the like. The plunger may be made out of a polymer such as polyester, polypropylene, polyamide and the like.

An exemplary plunger may comprise one or more fins that extend out from the shaft. The fins may provide additional agitation and movement of the laundry during the plunging step or may be used to spin the laundry, whereby a user spins the handle to rotate the shaft and the fins coupled thereto. The fins may extend outward from the length of the shaft and may extend orthogonally from the length of the shaft. Preferably, the fins are configured in the section of the shaft that is more proximal to the plunger cup. The fins may extend out from the shaft beyond the outer perimeter of the lower flange of the plunger cup, or about to the outer perimeter of the lower flange, to provide an effective amount of surface area for agitating the laundry. Put another way, the fins may have a width outward from the shaft that is substantially the same as outer perimeter of the lower flange or about 75% or more of the radius of the plunger cup. The fins may extend out less than the outer perimeter of the lower flange however. A fin may have a width out from the shaft of about 3 cm or more, about 5 cm or more, about 7.5 cm or more, about 10 cm or more, about 15 cm or more, about 20 cm or more and any range between and including the width values provided. The fins may provide effective paddles for rotating the laundry within the wash liquid. A plunger may be configured with about one, two or three fins to enable enough room between the fins for the laundry to collect for agitation. If there are too many fins, the laundry may not effectively collect and be moved by the fins during plunging or during rotation of the shaft.

An exemplary plunger-wash bag apparatus is configured to enable a laundry to be washed in remote locations. The upper opening of the wash bag may be opened, such as by unfolding the flexible receptacle and stiffener and unfastening the fastener. The valve opening may be sealed with the valve cap if detached and opened. With the upper opening open, laundry articles may then be placed within the wash bag, along with water and detergent. Detergent may include powder or liquid detergents including, soap, bleach, spot removers, fresheners, softeners and the like. An appropriate ratio of water to laundry may be used to ensure the laundry is effectively soaked during the washing process. With the water, detergent and dirty laundry in the wash bag, the plunger can be placed into the interior of the wash bag through the upper opening with the plunger cup extending down into the wash bag. The plunging motion may be performed from 0.5 to 3 minutes, or any length of time the user deems necessary to activate the suds and clean the laundry. Optionally, the stabilizing strap may be pulled upwardly to stabilize the wash bag during plunging. After plunging to wash the laundry, the plunger is removed from the wash bag and the upper opening is closed and folded over the stiffener a plurality of times, such as two, three or four times to seal the upper opening. A greater number or folds may better ensure an effective seal of the upper opening. The fastener, can then be pulled together and fastened. To drain the wash liquid from the wash bag in the sealed configuration with the top folded over, the user may remove the valve cap, and drain the liquid through the valve opening, such as by raising or tilting the wash bag to allow the liquid to pour out of the valve opening. Optionally, the user may wish to compress the bag by squeezing the wash bag to force liquid out of the valve opening. In embodiments with a drain opening or drain valve, a drain cap may be removed and an effective amount of liquid may drain automatically through the drain valve without tiling of moving the wash bag, as the drain opening is configured proximal to the bottom of the wash bag. This wash step may be repeated as needed. After the washing step, clean water may be poured into the wash bag via the valve opening or the upper opening. The plunger may again be inserted into the upper opening of the wash bag and plunged up and down to rinse the laundry. The user may wish to cover the valve opening with the valve cap. The user may also wish to shake, swill, etc. to rinse remaining dirty water and suds from the laundry. This step may be repeated as needed to rinse the interior and the clean laundry.

To dry, the user removes the laundry from the interior of the wash bag to dry via any desired method including, but not limited to hanging, laying out, tumbling device, wringing and the like. The stabilizing strap may be clipped or otherwise attached to a receiver such as a D-ring clip, loop, etc. In this embodiment, the D-ring clip is located adjacent the central axis and the flat bottom of the wash bag. In use, the stabilizing strap is then hung upside-down to allow the bag to dry. In some embodiments, the stabilizing strap may be attached to another part of the elongated bag, as deemed suitable by the manufacturer.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
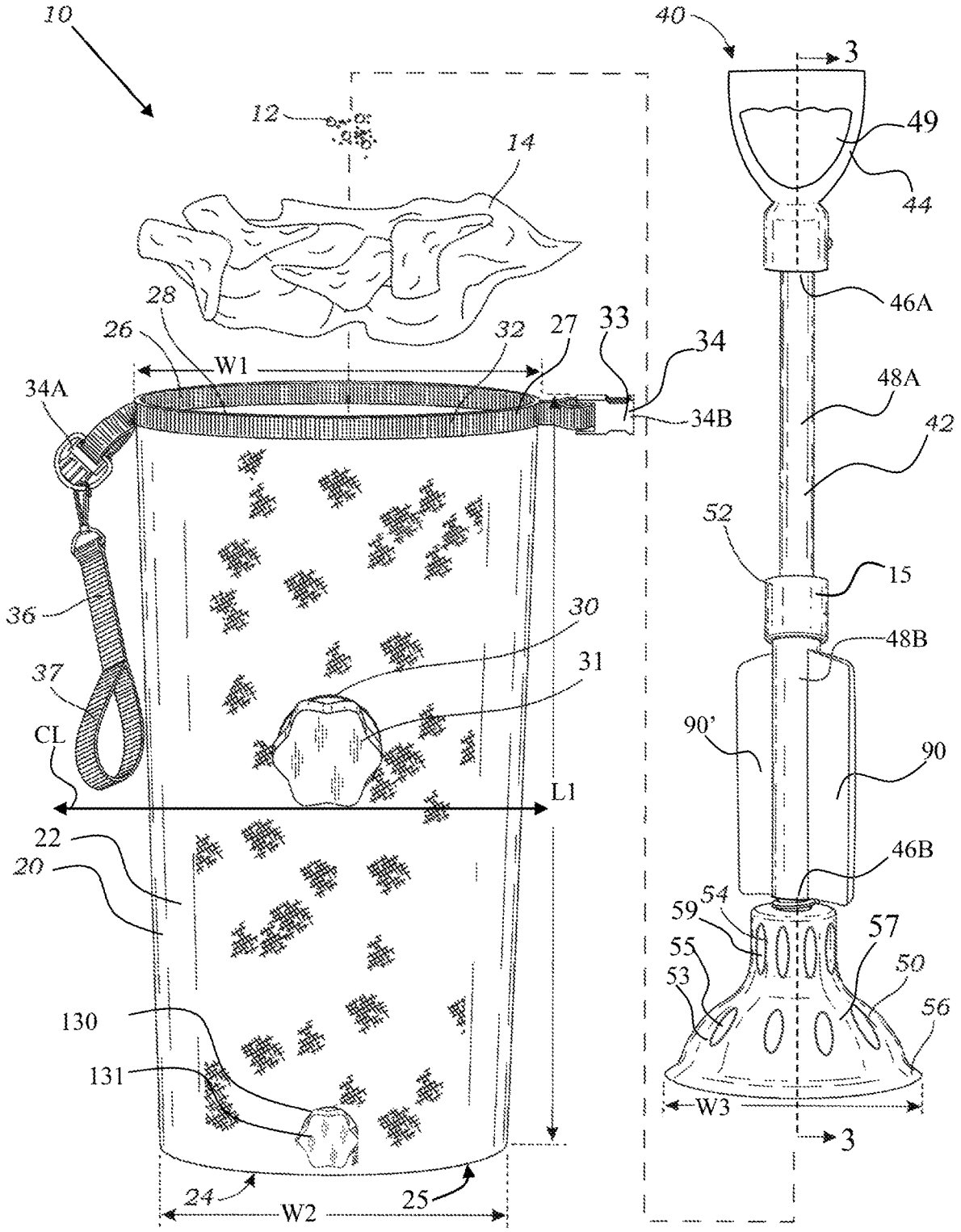
FIG. 1 shows a front view of an exemplary plunger-wash bag apparatus comprising a wash bag and a plunger.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
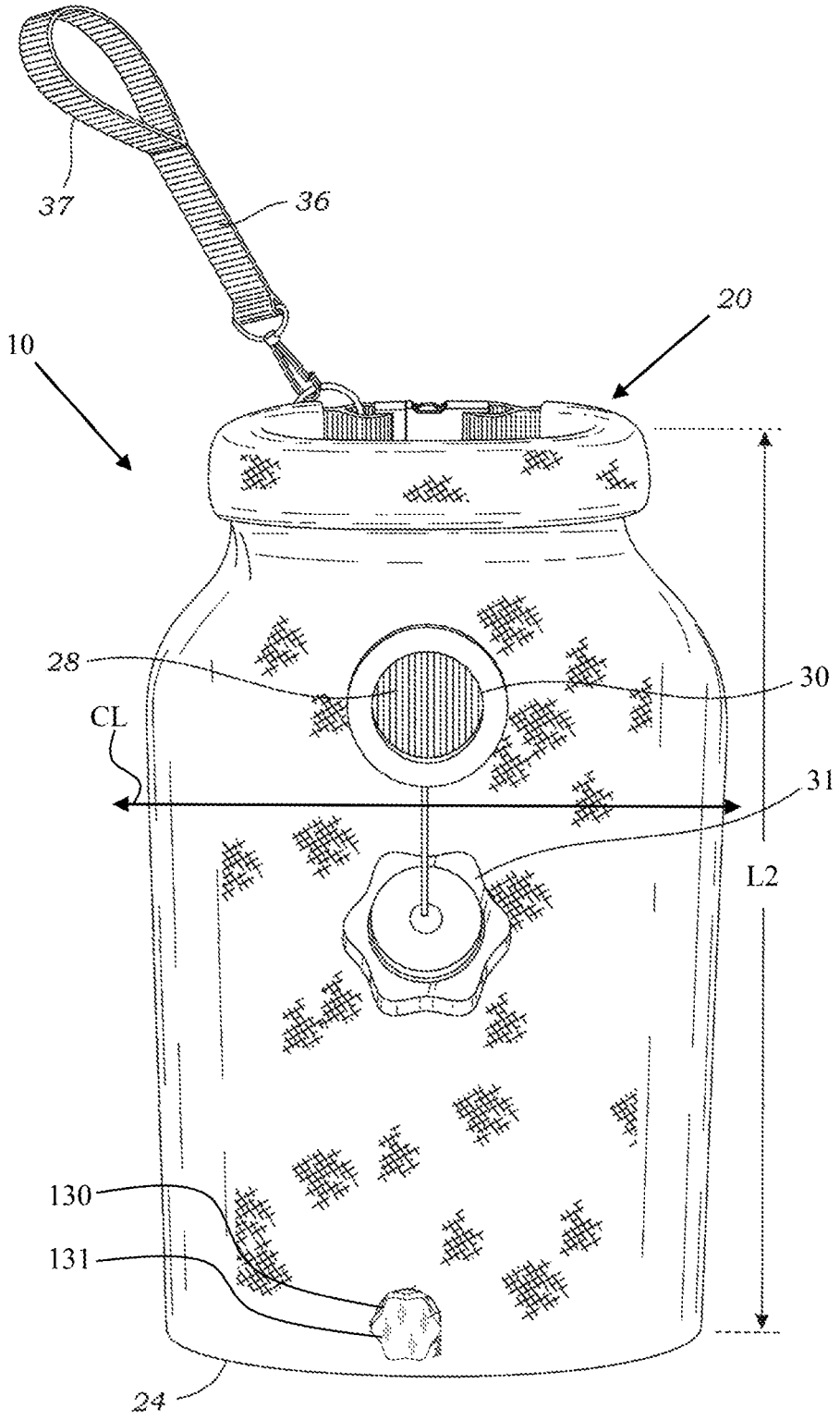
FIG. 2 shows a perspective view of an exemplary wash bag of a wash bag apparatus having the top folded over a plurality of times to seal the upper opening and the valve cap detached from the valve opening.
Figure 3:
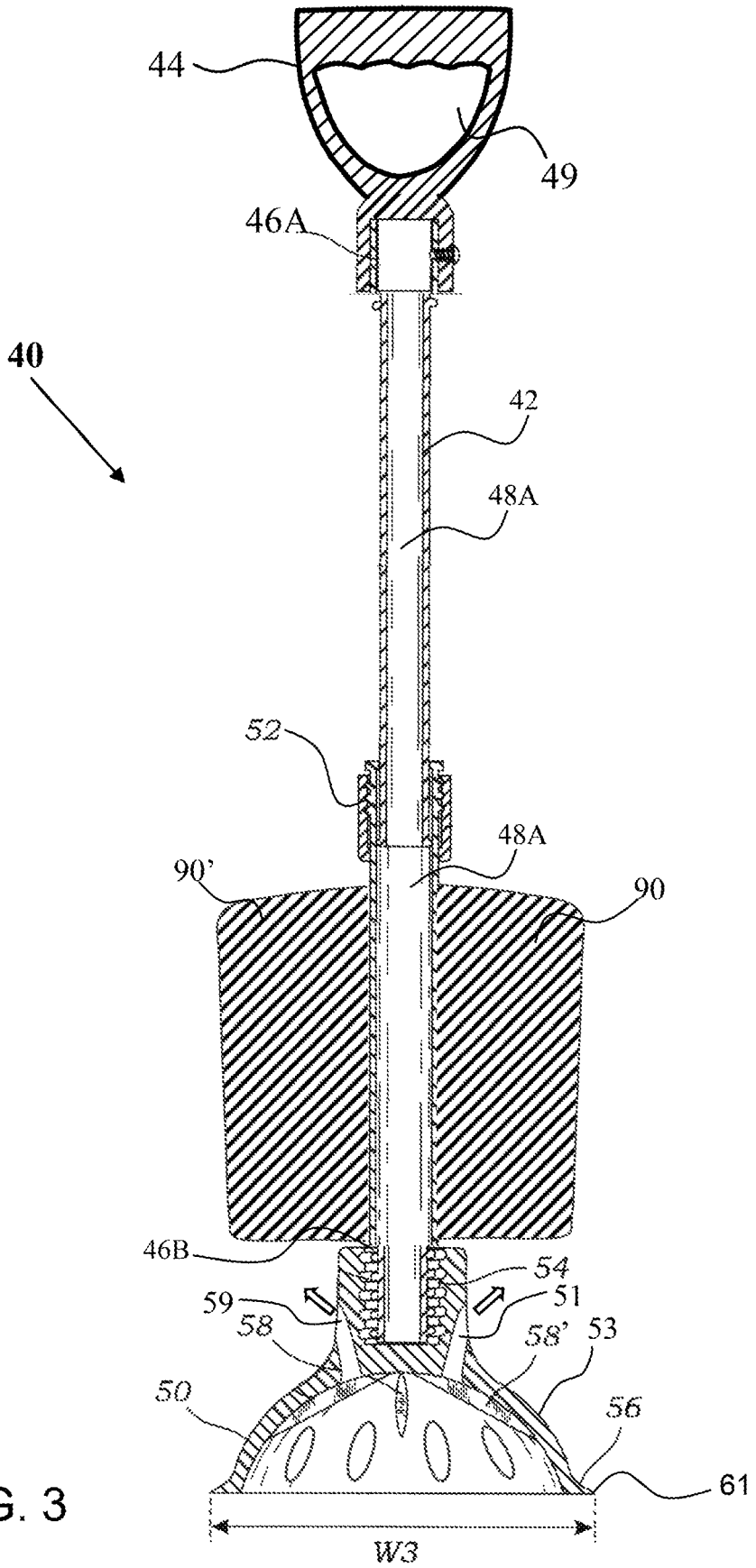
FIG. 3 shows a cross-sectional view of the exemplary plunger taken along line 3-3 in FIG. 1.

Referring now to FIGS. 1 to 3, an exemplary plunger-wash bag apparatus 10 comprises a wash bag 20 and a plunger 40 having a plunger cup 50 configured to move up and down within the wash bag to agitate and wash laundry therein. The was bag may be an elongated was bag as described herein. Laundry 14 may be inserted into the interior 28 of the wash bag along with water and detergent 12 and the valve cap 31 may be placed over the valve opening 30 to seal the valve opening closed. The plunger cup may then be inserted through the upper opening 26 of the wash bag and moved up and down. The plunger cup 50 has a width W3 that is less than the width or diameter of the upper opening W1 of the wash bag to enable the plunger cup to extend down into the flexible receptacle 22 to agitate and wash the laundry within the wash bag.

The wash bag is an elongated wash bag having a length L1 from the base or bottom 24 to the upper opening 26. The length L1 may be at least twice the width W2 of the base 25. The wash bag 20 has a flexible receptacle 22, a flat bottom 24 and an upper opening 26. The wash bag comprises a flexible receptacle that may be stiff enough to enable the wash bag to be free standing on the base 25. The wash bag may have a flat bottom 24 that further enables the wash bag to be free standing. The wash bag may be substantially uniform in dimension from the base 25 to the top 27 or upper opening 26, wherein the base is within about 10% or preferably within about 5% of the dimension of the upper opening. The wash bag may taper in dimension from the upper opening 26 to the bottom 24, thereby providing a larger opening for access and plunging the clothing. The flat bottom or base may be circular and the width of the base may be a diameter. The upper opening 26 of the wash bag may be configured with a stiffener 32 that is more rigid that the flexible receptacle 22 material. The stiffener may be a strip of material configured along the top opening that enables the top of the wash bag to be folded over the stiffener and then folded over a number of times to effectively seal the top opening of the wash bag. The stiffener may extend along one side of the upper opening or along the entire perimeter of the upper opening, as shown in FIG. 1. A fastener 33 may be a snap-fit buckle type fastener having an insert portion 34A and a receiver portion 34B. As shown in FIG. 2, the upper opening of the wash bag has been folded down over the stiffener a number of times and the fastener is coupled together to secure this folded down configuration. The length L2 of the wash bag is reduced due to the folding over of the upper opening. A stabilizing strap 36 may extend from the wash bag and may have a hand-loop 37 that may be held during the washing process to stabilize the wash bag in an upright configuration.

A wash bag has a valve opening 30 configured to allow liquid to drain from or liquid to be inserted into the interior 28 of the wash bag 20. The valve has a valve cap 31 configured to seal the valve opening. The valve opening may be configured more proximal to the upper opening, or top of the wash bag than the bottom of the wash bag, or about ⅝ up along the length of the wash bag from the bottom 24 or more or about ¾ from the bottom 24 or more. Put another way, the valve opening 30 may be configured between a centerline CL of the wash bag and the upper opening 26 of wash bag, wherein the centerline CL is the center line of the wash bag length L1, between the bottom of the wash bag and the upper opening of the wash bag. The valve may be opened to allow liquid, such as dirty wash water to drain from the wash bag and clean water may be poured into the wash bag through the valve opening, for example. A wash bag may have a second valve opening, or a drain opening 130 configured more proximal to the bottom of the wash bag to allow liquid to be drained from the wash bag without tilting or lifting the wash bag. This secondary drain opening may also have a drain cap 131 configured to seal the drain opening closed. The drain opening may be configured up from the base no more than about 10 cm, or no more than about 5 cm, or no more than 3 cm, or no more than about 2 cm and any range between and including the distances provided. The closer the drain opening is to the base, the more completely liquid can be drained from the wash bag without lifting the wash bag, which may be most useful for larger wash bags.

An exemplary plunger 40 has a shaft 42 that extends from a handle 44, on a handle end 46A, to a plunger cup 50, on a plunger end 46B. The handle has a handle opening 49 to enable better manipulation and control of the plunger. The shaft may be collapsible in length to aid in storing and transport. An adjustment feature 15, such as an adjustment ring 52, may be used to modify the length of the shaft and may be used to lock a first shaft section 48A in a fixed position with respect to a second shaft section 48B. The second shaft section may be telescoping with the first shaft section, or vice versa. As shown the first shaft section 48A is configured to slide into the second shaft section 486. The shaft may include one or more fins 90, 90' coupled to and extending from the shaft 42. As shown in FIG. 1, two fins 90, 90' extend from the second shaft section 48B, or the section more proximal to the plunger cup 50. A user may spin the handle to spin the laundry within the wash bag to enable more effective cleaning or rinsing. A user may simply plunge up and down and the fins may grab and move laundry up and down to produce more agitation of the laundry. As shown in FIG. 3, the fins extend out to about the perimeter of the lower flange 56 of the plunger cup 50.

The plunger cup may have an upper receiver portion 54 configured to receive and retain the shaft, which may be threaded to engage with threads of the plunger end of the shaft, as shown in FIG. 3. The plunger cup also has a flared portion 53 that flares outward from the upper receiver to the lower flange 56. The plunger cup 50 has cup apertures 55 that allow liquid and/or air to flow therethrough to prevent suction and to produce a flow of liquid therethrough to more effectively wash clothing during the plunging step. An exemplary plunger cup may have one or more cup apertures 55, or apertures in the flared portion 53 of the cup portion 57 of the plunger cup 50. As shown, the cup apertures 55 are configured about every 45 degrees around the perimeter of the plunger cup to provide eight cup apertures with four being shown. As described herein, a plunger cup may have one or more cup apertures, and preferably there may be about three to eight cup apertures. An exemplary plunger cup may also have one or more receiver apertures 59, apertures configured in the receiver portion 54 of the plunger cup. As shown, the receiver apertures 59 are configured about every 60 degrees or less around the receiver portion of the plunger. A receiver aperture channel 51 extends from the interior of the flared portion 53 of the plunger cup to the exterior of the receiver portion, as shown in FIG. 3, to produce a rush or jet of water flowing out of the receiver aperture when the plunger is plunged down into the wash bag. The receiver apertures may produce a stronger jet of liquid than the cup apertures as a result of their orientation, size and the receiver aperture channel. An exemplary plunger cup may have about one to four receiver apertures, as too many may compromise the stability of the plunger cup. The receiver apertures in the receiver portion may be a different size than the cup apertures in the flared portion of the plunger cup. The apertures may allow air and liquid to pass through the plunger cup to prevent the plunger from having too much resistance when moved up and down within the wash bag. The plunger may have strengthening ribs 58, 58', as shown in FIG. 3 to prevent the plunger from deflecting or deforming during the washing process.

Figure 4:
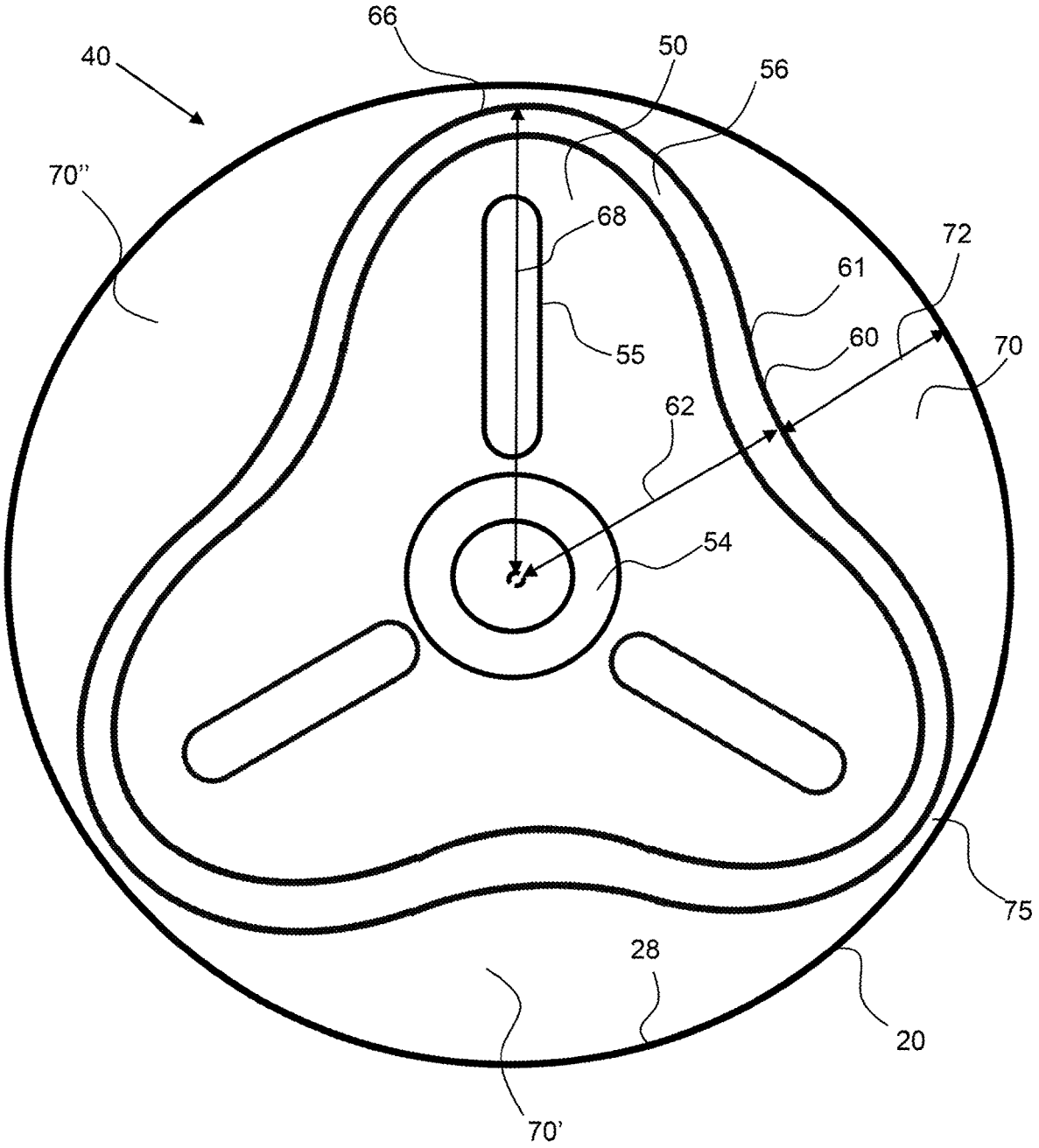
FIG. 4 show a top view of a plunder cup having three perimeter indentations that form three perimeter flow channels.

As shown in FIG. 4, a plunger cup 50 has a perimeter 61 that is smooth curved surfaces with three perimeter indentations 60 alternating about the perimeter with three perimeter protrusions 66, forming three perimeter flow channels 70, 70' and 70" between the outer perimeter, or lower flange 56 of the plunger cup, and the interior 28 of the wash bag 20. A perimeter flow channel may have a perimeter flow channel width 72 of about 10 mm or more, about 20 mm or more, about 30 mm or more and any range between and including the width values provided. These perimeter flow channels may produce a high velocity of water, or a rush of water up and down, as the plunger is moved up and down within the wash bag and these high velocity flows of water around the plunger cup 50 may more effectively wash laundry. Note that the perimeter indentations have an innermost radial extension length 62, the length from the center of the plunger cup to the most radially inward portion of the perimeter indentation, that may be 75% or less or even 50% or less than and outermost radial extension length 68 of a plunger protrusion, the length from the center of the plunger cup to the most radially outward portion of the perimeter protrusion 68. This particular design is a petal design having three perimeter indentations configured at 120 degree intervals about the plunger with three perimeter protrusions configured therebetween. The outer perimeter of the plunger cup may forma a perimeter gap 75 between the outermost portion of the perimeter protrusion 66 and the interior 28 of the wash bag. Note that the area formed between the perimeter indentations and the interior of the wash bag is about 10% or more the interior area of the wash and may be 15% or more, 20% or more, or even 25% or more.

As shown in FIG. 4 the plunger cup 50 has three cup apertures 55 that are elongated having a length that is at least three times the width of the cup apertures. The length of the cup apertures each extend radially along the perimeter protrusions 66.

Figure 5:
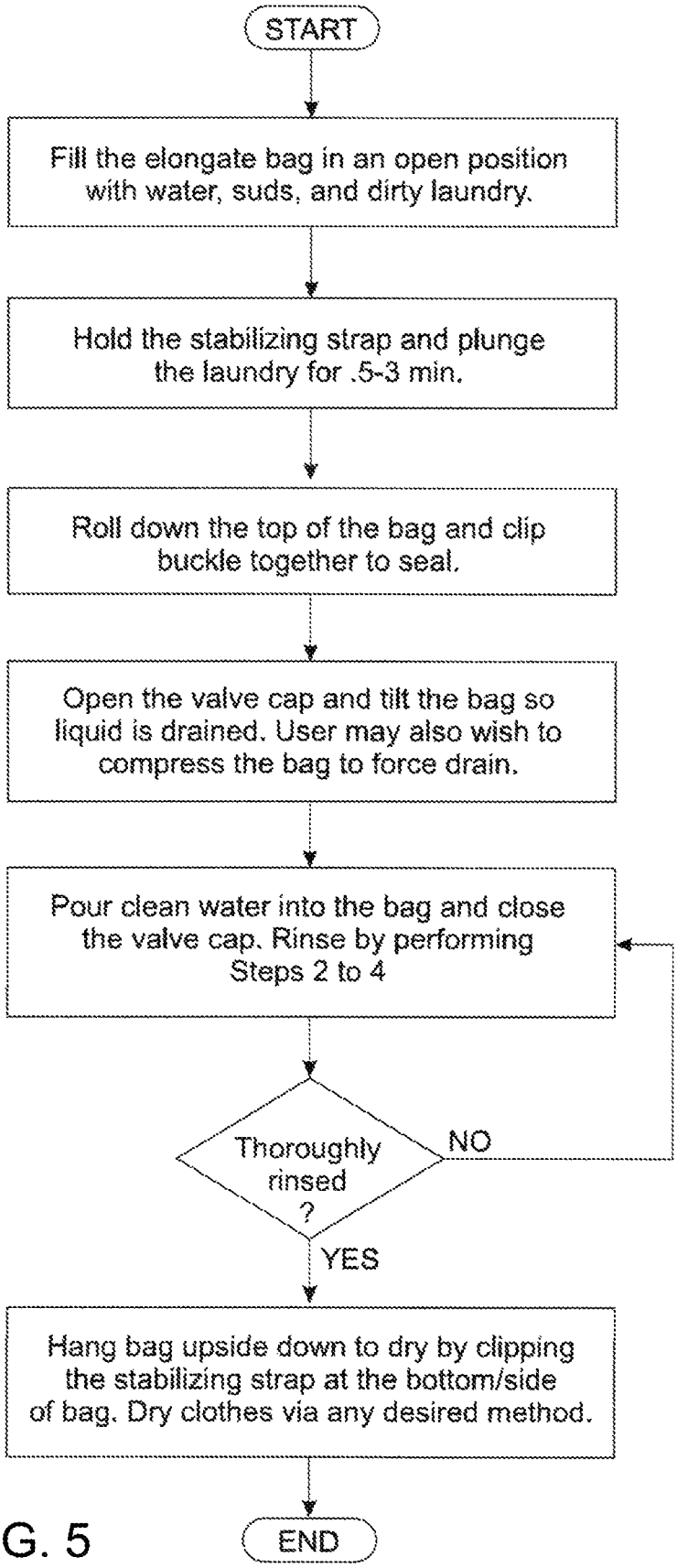
FIG. 5 shows a flow diagram of a method of using the plunger-wash bag.

As shown in FIG. 5, and with reference to FIGS. 1 to 3, a method of using the plunger-wash bag apparatus 10 is provided. In some embodiments, the wash bag 20 may include instruction graphics (not shown), printed or otherwise attached, detailing how a user might wash laundry without electricity using the plunger-wash bag apparatus 10. At a first step of cleaning, the wash bag 20 is in the unrolled position with the valve cap 31 tightened on the valve opening 30, The user adds water, detergent 12 (suds), and dirty laundry 14 (shown in FIG. 1) to the interior 28 of the wash bag 20. In some uses of the present invention, the user may wish to use alternative or additional cleaning items, fresheners, soaps, etc. The wash bag 20 may be provided in multiple sizes for holding different volumes of liquid. For example, in one embodiment, the interior 28 may contain about 45 liters of volume or more, about 30 liters of volume or more, about 20 liters of volume or more, or about 10 liters of volume or more, and any range between and including the volumes provided. In some embodiments, water required for load capacity may be 3.5-5 liters for every 10 liters of interior volume. Obviously, other sizes of the wash bag 20 may be constructed using the proportions provided herein, which should be considered within the scope of the present invention.

At a next step of the method the user plunges the contents of the interior 28 using the plunger 40. The plunging motion may be performed from 0.5 to 3 minutes, or any length of time the user deems necessary to activate the detergent 12 and clean the laundry 14. Optionally, the stabilizing strap 36 may be pulled upwardly to stabilize the wash bag 20 during plunging. After plunging, the user pinches the upper opening 26 with the buckles 34 at either end, and rolls or folds the wash bag 20 downwardly to fasten the buckles 34 together. The stiffener 32, comprising a semi rigid material may create a tactile reference so that the wash bag 20 is symmetrically rolled and creates a seal. To drain the liquid from the wash bag 20 in the rolled position, user removes the valve cap 31, and raises and tilts the wash bag 20 so the liquid is poured out of the valve opening 30. User may also wish to compress the wash bag 20 using body weight to force drainage. This step may be repeated as needed. At a rinsing step, clean water may be poured into the wash bag 20 via the valve opening 30 or the upper opening 26. The user may wish to cover the valve opening 30 with the valve cap 31, and then repeat the earlier plunging step to rinse. The user may also wish to shake, swill, etc, to rinse remaining dirty water and suds from the laundry. This step may be repeated as needed to rinse the interior 28 and the clean laundry.

To dry, the user removes the laundry 14 from the interior 28 of the wash bag 20 to dry via any desired method (hanging, laying out, using a tumbling device, wringing, etc.). The stabilizing strap 36 may be clipped or otherwise attached to a receiver (not shown) such as a D-ring clip, loop, etc. In this embodiment, the D-ring clip is located adjacent the central axis and the flat bottom 24 of the wash bag 20. In use, the stabilizing strap 36 is then hung upside-down to allow the wash bag 20 to dry. In some embodiments, the stabilizing strap 36 may be attached to another part of the wash bag 20, as deemed suitable by the manufacturer.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of washing laundry comprising:

a) providing a plunger-wash bag apparatus comprising:
  i) a wash bag comprising:
  a flexible receptacle extending from a bottom to an upper opening and forming an interior for receiving said laundry;
  a stiffener extending along said upper opening;
  a fastener coupled with said stiffener;
  a valve opening configured in said flexible receptacle between a centerline of a wash bag length and the upper opening; and
  a valve cap configured to detachably attach to said valve opening to seal said valve opening closed;
  ii) a plunger comprising:
  a plunger handle;
  a plunger cup comprising an upper receiver portion and cup portion that flares radially outward from the receiver portion to a lower flange, said lower flange having a flange width configured to fit through the upper opening of the wash bag and wherein the plunger cup is configured to extend down into the wash bag through the upper opening; and
  a plunger shaft extending from said plunger cup to said plunger handle;

b) providing a detergent;

c) placing said laundry into the interior of the wash bag;

d) placing the detergent and water into the interior of the wash bag;

e) inserting the plunger cup into the wash bag through the upper opening;

f) plunging the laundry by moving the plunger up and down within the wash bag for a washing time;

g) removing the plunger from the wash bag;

h) rolling the upper opening down to fold the flexible receptacle over the stiffener an effective number of times to prevent leaking of said water;

i) fastening the fastener to retain the upper opening in a rolled down configuration;

j) removing the valve cap from the valve opening;

k) draining the water and detergent out from the valve opening;

l) unfastening the fastener and unfolding the upper opening to open the upper opening;

m) inserting rinse water into the interior of the wash bag;

n) replacing the valve cap on the valve opening;

o) agitating the laundry and water within the wash bag to rinse the laundry;

p) rolling the upper opening down to fold the flexible receptacle over the stiffener an effective number of times to prevent leaking of said water;

q) removing the valve cap; and r) draining the water from the valve opening to produce washed laundry.

2. The method of claim 1, further comprising compressing the wash bag after draining the water and detergent out from the valve opening and before replacing the valve cap.

3. The method of claim 1, wherein draining the water and detergent out from the valve opening includes compressing the wash bag to force said water and detergent out of the valve opening.

4. The method of claim 1, wherein inserting rinse water into the interior of the wash is through the valve opening.

5. The method of claim 1, wherein agitating the laundry comprises plunging the laundry by moving the plunger up and down within the wash bag for a rinsing time.

6. The method of claim 1, wherein agitating the laundry comprises moving the wash bag to agitate the laundry.

7. The method of claim 1, wherein the fastener comprises a buckle having a male portion and a female portion, wherein the male portion is configured to detachably attach to the female portion by insertion into the female portion.

8. The method of claim 1, wherein the flexible receptacle of the wash bag comprises a waterproof fabric.

9. The method of claim 1, wherein the flexible receptacle of the wash bag consists of a polymer film.

10. The method of claim 1, wherein the bottom of the wash bag comprises a flat bottom portion that extends within a perimeter of the bottom.

11. The method of claim 1, wherein the flexible receptacle tapers from the upper opening to a base.

12. The method of claim 11, wherein the bottom has a width that is at least 5% smaller than a width of the upper opening.

13. The method of claim 1, wherein the plunger shaft is collapsible and comprises a plunger retainer ring configured between a first plunger shaft section and a second plunger shaft section.

14. The method of claim 1, wherein the plunger cup comprises a cup aperture configured in a cup portion of the plunger cup.

15. The method of claim 1, wherein the plunger cup comprises two cup apertures configured in a cup portion of the plunger cup.

16. The method of claim 1, wherein the plunger cup comprises two receiver apertures configured in the upper receiver portion of the plunger cup.

17. The method of claim 1, wherein the plunger cup comprises two receiver apertures configured in the upper receiver portion of the plunger cup.

18. The method of claim 1, wherein the plunger cup comprises stiffening ribs.

19. The method of claim 1, wherein the plunger comprises a fin coupled to and extending out from the plunger shaft.

20. The method of claim 19, where the fin has a width substantially a same radius of the plunger cup.

21. The method of claim 1, wherein the plunger cup has a perimeter with a perimeter indentation forming a perimeter flow channel between the perimeter indentation and an interior of the wash bag.

22. The method of claim 1, comprising two or more perimeter indentations configured between perimeter protrusions of the plunger cup to form a respective perimeter flow channel between each of the two or more perimeter indentations and an interior of the wash bag.

23. The method of claim 22, wherein the perimeter indentation has an innermost radial extension length that is 75% or less an outermost radial extension length of said perimeter protrusions.

24. The method of claim 23, wherein the plunger cup comprises stiffening ribs.

25. The method of claim 1, further comprising i) a drain opening configured in said flexible receptacle more proximal to said bottom than to said upper opening; and ii) a drain cap configured to close said drain opening to seal said drain opening closed.

26. The method of claim 25, wherein the drain opening is configured no more than 20 cm up from a bottom of the wash bag.

* * * * *